United States Patent [19]

Moon

[11] 3,946,447

[45] Mar. 30, 1976

[54] AUXILIARY WATER SAVING ATTACHMENT FOR WATER CLOSETS

[75] Inventor: Jacob R. Moon, Hillsborough, N.C.

[73] Assignee: Moon Water Saver, Inc., Hillsborough, N.C.

[22] Filed: Oct. 21, 1971

[21] Appl. No.: 191,228

[52] U.S. Cl. ..... 4/1; 4/18 R; 4/34; 4/35; 4/67 A

[51] Int. Cl.[2] ..... A47K 17/00; E03D 1/22

[58] Field of Search ..... 4/1, 18, 18.5, 57, 57 P, 4/67, 67 A, 52, 41, 42, 20, 28, 35

[56] References Cited

UNITED STATES PATENTS

| | | | |
|---|---|---|---|
| 383,045 | 5/1888 | Crawford | 4/35 |
| 1,323,703 | 12/1919 | Linfoot | 4/18 |
| 1,940,106 | 12/1933 | Snyder | 93/58.2 R |
| 2,503,874 | 4/1950 | Ives | 93/58.2 R |
| 3,041,630 | 7/1962 | Williams | 4/57.2 R X |
| 3,151,337 | 10/1964 | Deniz | 4/67 A |
| 3,259,918 | 7/1966 | Walker, Sr. et al. | 4/18 |

*Primary Examiner*—Henry K. Artis
*Attorney, Agent, or Firm*—B. B. Olive

[57] ABSTRACT

The amount of water used in evacuating the bowl of a water closet is substantially reduced by an auxiliary device that is installed in the conventional closet water tank and which forms an open ended column around the valve so that water stored in the base of the tank and around the column is prevented from being discharged during flushing.

11 Claims, 10 Drawing Figures

INVENTOR.
JACOB R. MOON

BY

B. B. Olive
ATTORNEY

AUXILIARY WATER SAVING ATTACHMENT FOR WATER CLOSETS

CROSS REFERENCE TO THE RELATED APPLICATION

This application relates and constitutes an improvement over copending application Ser. No. 105,032, entitled "Water Saving Apparatus and Method for Water Closets" by the same inventor.

BACKGROUND OF THE INVENTION

1. Field of the Invention

The invention relates to water closets and particularly to the type having a relatively deep rectangular water storage tank. More specifically, the invention relates to devices which may be installed in such water closets for the purpose of reducing the amount of water consumed during flushing.

2. Description of the Prior Art

A common type of water closet in widespread household, hotel, motel and institutional use employs a relatively deep, rectangular tank in which the valve mechanism is mounted. Water closets have heretofore been adapted to save water in effecting bowl evacuation by various modifications of the water tank. Prevalent modifications comprise multiple water compartments in series as in U.S. Pat. No. 2,715,228, or in alternative arrangements as in U.S. Pat. No. 3,344,439. Additionally, the mechanical flush controls have been modified to provide choices of flush such as full and watersaving. A recent example of the latter is found in U.S. Pat. No. 3,538,519. While achieving the objective of saving water in accomplishing an adequate flush the prior art requires modifications beyond the capability of the ordinary home owner, such as tank fabrication or quite precise mechanical arrangements to achieve mechanically actuated and controlled flushes utilizing less than all of the water in the water tank. As a result, the prior art is practically and economically restricted to practice by water closet and plumbing manufacturers.

The majority of water closets found in homes and in many hotels, motels, institutions, etc., whether old or new are of the standard deep rectangular tank model variety of any given manufacturer due to their lower costs. Home owners desiring to effect water savings in accordance with the objects of this invention must therefor incur the expense of purchasing and having installed new plumbing or new water closets manufactured in accordance with the prior art. However, the prior art does not provide an inexpensive, easily and quickly installed water saving device for previously installed water closets which maintains the quality of water flow during flush and thereby maintain the quality of bowl side washing per unit of water utilized.

In the referred to copending application Ser. No. 105,032, there is taught the concept of providing a flexible, four walled, rectangular, box having open ends and which can be assembled within a water tank to provide an open ended column surrounding the valve. Various means are taught to retain the box in place once installed and to accommodate to trade variations in the specific style of water tank. With such a box in place, when the tank is flushed the box prevents the volume of water within the tank and surrounding the box from being discharged thus causing a very substantial savings in the amount of water consumed. While the device and method of the copending application are believed to be unique and to have been the first teaching of a method and auxiliary apparatus of this kind which adapts to an existing tank a need for improvement has been revealed and such is the object of the present invention.

SUMMARY OF THE INVENTION

In the preferred embodiment of the invention the apparatus of the invention comprises a rectangular sheet of flexible, plastic material having fold lines adapted to form a U-shaped, five wall structure. This structure once formed into five walls is in turn adapted to be secured by a pair of spring loaded plunger rods to an interior vertical wall surface of the closet water tank and in a position such that the five walls sit on the bottom of the tank and surround the water valve. An open ended column is thus formed by the U-shaped five walls of the structure and the vertical tank wall surface which completes the column wall and sealing strips are provided around the contacting edges of the structure walls with the tank. When the tank is flushed by opening the valve the water level drops essentially to the level of the top of the column and all water surrounding the column and stored within the tank is saved. As a modification of the apparatus, means are provided whereby the structure can have a semi-circular portion of one of the walls knocked out so as to accommodate to the type of tank having an interior ridge.

DESCRIPTION OF THE PREFERRED EMBODIMENTS

Figure 1:
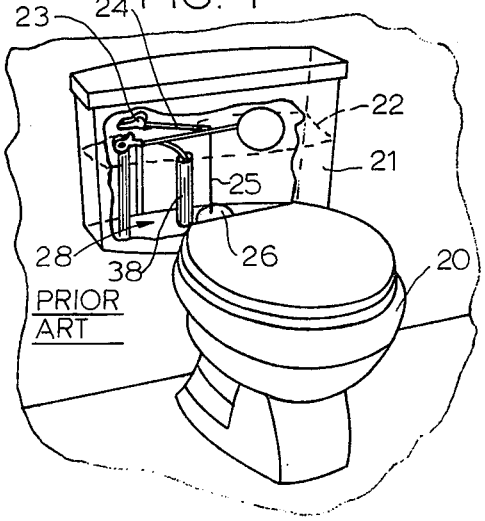
FIG. 1 is a perspective view of a conventional water closet with a portion of its water tank cut away to reveal internal plumbing, its full flush water line and its valve seating water line.

FIG. 1 shows a typical conventional water closet having a deep rectangular shape and consisting of a bowl 20 and a water tank 21 connected to a water supply, not shown. Water tank 21 contains a volume of water controlled by the usual internal water supply plumbing and the surface of which, when the tank is full, is typically from eight to ten inches above the tank bottom as represented by full flush water level 22. A valve 26 seats adjacent the tank bottom in one end of the tank exit pipe or conduit, not shown. The water surface reaches level 28, the normal valve seating water level, during a normal flush at which time the valve 26 becomes seated. As is well known in the art, the flush itself is initiated by depressing handle 23 which pivots upwardly rod 24 to which is attached a chain 25. Chain 25 is also attached to ball valve 26 and causes its unseating whenever handle 23 is sufficiently depressed. As is also well known in the art the draining water interfacing valve 26 and the tank exit pipe, not shown, retains valve 26 in an unseated position until the water level reaches level 28. The water exiting tank 21 through the tank exit pipe enters bowl 20 and forms a head of water therein sufficient to cause bowl evacuation by siphonic action.

It is to be noted that this invention recognizes that not all of the water normally exiting tank 21 is actually needed in bowl 20 to accomplish siphonic bowl evacuation in standard water closet tanks having a full flush water level of from eight to ten inches. That is, siphonic bowl evacuation has been observed to begin before valve seating. The invention also recognizes that if the valve is caused to be seated nearer the time bowl evacuation is initiated, less water will be utilized than will be the case when water is allowed to be substantially depleted from tank 21 after a sufficient head is created in bowl 20 to cause the siphonic evacuation. The term "head", as used herein, simply refers to a height or vertical column of water as is commonly employed in hydrostatic terminology. The head of water in the water closet tank is directly related to the velocity of draining water through the tank exit pipe since the water closet is an "open" system; that is, exposed to atmospheric pressure on both sides of the body of water. Therefore, to simply adjust the water closet mechanics to achieve a lower full-flush water line below level 22 would not meet the objectives of this invention in that a lesser head of water would produce a smaller exiting velocity through pipe 27 and less turbulent water flow, therefor, for any given water closet configuration. This would diminish the quality of bowl side washing per unit of water utilized because the more turbulent the flow the more sporatic the path of travel for the water and the more vigorous the washing effect. The method and apparatus of this invention employs the normal, full-flush head of water for any given water closet of the conventional deep, rectangular tank type thereby maintaining the aforementioned qualities of flush while saving a substantial portion of the water in tank 21 normally used in the flush.

Figure 5:
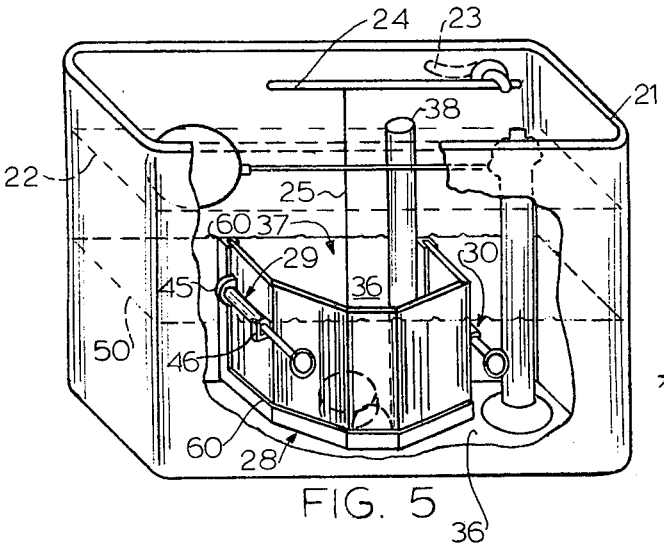
FIG. 5 is a perspective view of a conventional water tank with a portion of the tank cut away, with the plumbing simplified for purpose of illustration and with an apparatus made according to the invention installed.
Figure 6:
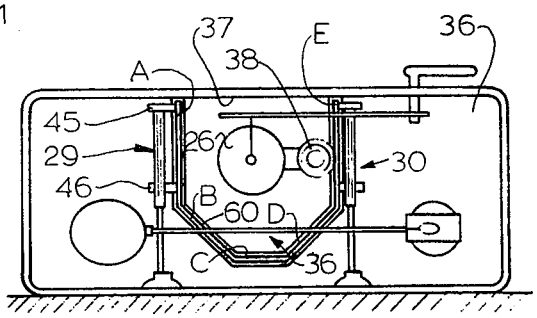
FIG. 6 is a top view showing the wall structure in position.
Figure 4:
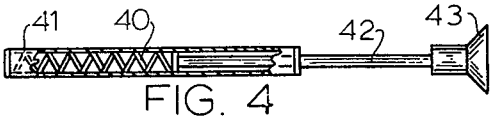
FIG. 4 is a partially cut away top view of one of the plunger rods used to retain the wall structure within the tank.
Figure 3:
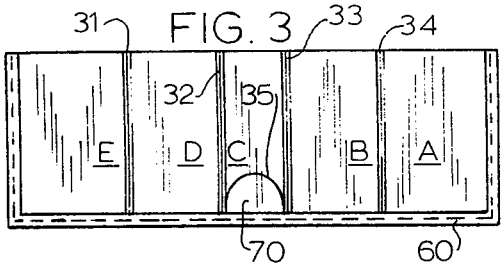
FIG. 3 is a rear elevation view of the wall structure of the invention.
Figure 2:
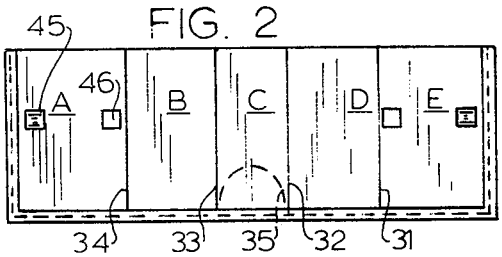
FIG. 2 is a front elevation view of the wall structure of the invention.
Figure 7:
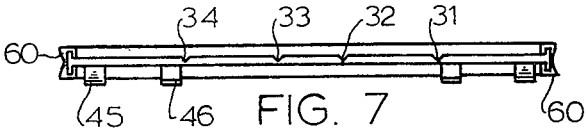
FIG. 7 is a top end view of the wall structure showing the details of the notches and plunger rod supports.
Figure 8:
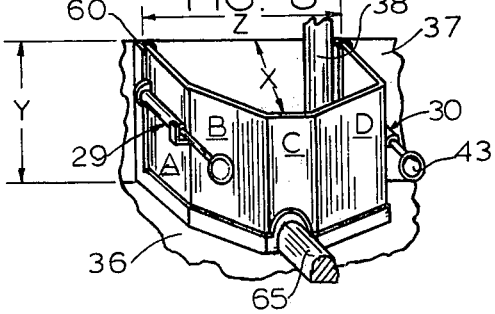
FIG. 8 is a perspective cut away view of a second embodiment accommodating to tanks having an internal ridge.

The preferred and first embodiment of the invention apparatus consists of a five-walled rectangular structure formed from a moderately flexible, scored and notched, thin rectangular sheet of plastic as shown in FIGS. 2, 3, 5, 6 and 7 and a pair of retaining plunger rod members as shown in FIGS. 4, 5 and 6. The sheet of plastic is scored along lines 31, 32, 33, 34 and 35 dividing the sheet into the five walls A, B, C, D and E. The scorings are such that when walls A and E are folded toward one another, until they are essentially parallel, walls B, C and D are positioned as shown in FIGS. 5 and 6. With the walls A, B, C, D and E so folded they may be introduced into tank 21 around valve 26 so as to have the bottom end edges rest on the tank bottom 36 and the vertical end edges against the inside tank wall surface 37 so as to achieve in effect a six-walled rectangular open ended, box or column configuration as shown in FIGS. 5 and 6, having, as indicated in FIG. 8, an approximate depth X of six inches, a width Z of six inches and a height Y of six inches.

The described column configuration is maintained by use of two spring loaded plunger rods 29, 30 respectively positioned as shown in FIGS. 5 and 6. Rods 29, 30 each have a spring 40 enclosed in a housing 41, a movable rod 42 tensioned by spring 40 and a rubber cup 43. Each respective housing 41 inserts in a molded receptacle 45 and a clip 46 formed on the respective sides of the wall structure. The device is placed on the tank bottom about both overflow pipe 38 and valve 26 will wall E adjacent pipe 38 and plunger rods 29, 30 positioned as shown in FIGS. 5 and 6.

As thus retained, the water saver effectively divides the volume of water under surface level 22 into two volumetric portions. One portion is in communication with the exit drain pipe when valve 26 is unseated and includes the water above the level shown by dotted line 50 of FIG. 5 and also includes the water within the water-saver column thus insuring utilization of the normal fullflush level water head and maintenance of normal flush water flow qualities. The other portion consists of the water confined below level 50 and outside the water-saver structure walls A, B, C, D and E. During flushing the water within the wall structure appears to descend at a faster rate than water outside the wall structure and in order to prevent leakage a suitable sealing strip 60 is employed on the edges of the wall structure contacting the tank surfaces. From this it can be seen that the amount of water saved during each flushing approximates that around the wall structure and between the tank bottom surface 36 and the surface level 50.

Since some tanks are built with a ridge 65 (FIG. 8) in the surface area of the bottom on which the wall structure of the invention is intended to rest, the wall C is made with a knock-out piece 70 defined by the core line 35. As best shown in FIG. 8 when piece 70 is knocked out and the sealing strip 60 rearranged as shown in FIG. 8 the wall structure readily adapts to the ridge 65 in the same manner as with tanks having smooth bottom wall surfaces. In both the ridge and non-ridge installations the device of the invention is normally installed between the front and back side walls of the tank.

From the foregoing, it can be seen that the invention provides an extremely simple method and auxiliary apparatus for modifying the water flow of the water closet having the type of tank described in such a way that very substantial quantities of water are saved. Considering the extremely critical shortage of water in many areas of the world in which the type water closet is employed, the advantages of a simple method and apparatus of this kind can be seen. Of particular advantage is the fact that the invention lends itself to being installed without tools, without requiring modification of the water closet, without requiring any skill and at absolutely nominal expense compared to the cost of water saved.

The size of the wall structure may vary with specific tank constructions and which normally have 0.5 to 1.0 cubic foot capacity. In one embodiment a ⅛ inch thick light flexible plastic is used. Walls A and E are made 3¾ × 5¼ inch. walls B and D are made 2¾ × 5¼ inches and wall C is made 2 × 5¼ inch. The edges which contact the tank wall are molded in a "T" configuration (FIG. 7) and a soft rubber cushion (i.e. seal 60) having a mating molded configuration and a cross section size of ⅜ × ⅝ inch is secured by stapling to the plastic. Other materials may be employed through plastic offers many advantages from the viewpoint of economy and durability. While shown bent into a U-like form it is obvious that any shape form in which the walls of the invention device are bent and partially closed on themselves and which uses an internal tank wall surface to complete the column effect will operate. The term "U-like" is therefore to be interpreted in this sense and includes semi-circular, V and similar forms.

Figure 9:
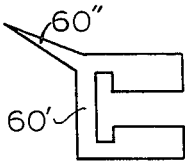
FIGS. 9 and 10 are top views of alternate edge seals having flaps.
Figure 10:
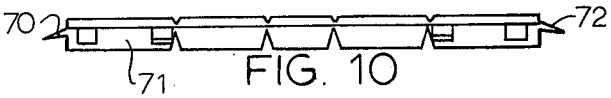

Note should also be taken of FIGS. 9 and 10 showing alternate forms of sealing in which the contacting edges are sealed by flaps. FIG. 9 shows the cross-section form of a sealing strip 60' having an integral tapered flap 60'' which can be pressed against the tank wall surface as a means for sealing. FIG. 10 shows a top view of a modified wall structure, as another embodiment, in which the wall structure itself is molded with integral tapered edges 70, 71, 72 which are adapted to serve as seals and which eliminates the need for an added sealing strip such as strip 60. From the foregoing, it can be seen that the edge seal may either be molded to snap on the edge as in the FIG. 7 T-slot and edge configuration or it may be molded or fused as part of the wall structure itself. In all cases the wall structure of the invention preserves the original water head, maintains the same Venturi and syphonic like actions of the flushing water, causes the ball valve to be buoyed as in the original tank and plumbing construction and operates in the original manner by gravity flow. Nevertheless, while maintaining these forces and characteristics only about one-half as much water is used.

Each flushing requires that the bowl 20 be refilled while the tank is being refilled. This is accomplished by a small feeder pipe, not shown, which passes water into the overflow drain pipe 38 while the tank is being refilled. When the main tank supply valve is cut off by the usual rising float ball the feeder pipe supply is also shut off. Substantial amounts of water are wasted merely by reason of using more than is necessary to refill the bowl 20. Therefore, another very important advantage of the present invention is that since the tank refill time is reduced approximately one-half the bowl refill time is reduced about one-half which in turn means that about 50% of the bowl refill water is saved.

What is claimed is:

1. In a water closet of the type having a tank formed by bottom and side walls and providing a hydraulic head and storage of predetermined height and capacity, having a movable flush valve mounted in the bottom wall of the tank and seated in one end of a conduit connecting the tank to a lower positioned bowl, having manual handle means to open the valve to empty the tank and cooperative water supply means for refilling the tank upon the valve returning to a closed position, the opening of the valve normally causing initiation of flushing and bowl evacuation followed by substantial emptying of the tank and then closing of the valve, the improvement comprising, in combination:

a. an auxiliary thin rectangular wall member adapted to be vertically positioned and bent within the tank into a U-like form whereby the end edges of the wall member contact an interior vertical wall surface of the tank and one of the side edges of the wall member contacts the interior bottom wall surface to form in effect an open top column extending above and around the valve and closed at the bottom by the bottom wall of the tank and closed at the sides by said interior vertical wall surface forming a continuation of the wall area of said wall member; and b. spring retainer means adapted to retain said wall member in said column form and with the respective contacting wall member end and side edges and tank wall surfaces in relatively tight engagement to minimize water flow therebetween, said wall member and retainer means thereby being effective upon said valve being opened to prevent emptying of said tank below a level substantially equal to the level of said column top end and to cause said valve to seat and said tank to start refilling substantially immediately after said evacuation.

2. In a water closet as claimed in claim 1 wherein said wall member comprises a thin rectangular plastic sheet folded along lateral scored lines to form said column as a five walled tubular structure.

3. In a water closet as claimed in claim 1 wherein said wall member on one side and at opposite ends is provided with a pair of receptacle configurations adapted to releasably receive a mating pair of said spring retainer means and each said spring retainer means comprises a spring loaded rod structure having a vacuum cup on one end adapted to engage an internal vertical wall surface opposite the internal vertical wall surface engaged by the ends of said wall member and with the opposite end of said rod structure being adapted to nest in one of said receptacle configurations whereby when a pair of said structures are installed within the tank said wall member is held in said U-form and said wall members end and side edges engaged.

4. In a water closet as claimed in claim 3 wherein said respective end and side edges of said wall member are provided with a deformable sealing strip.

5. In a water closet as claimed in claim 1 wherein said tank side walls include front, back and end side walls and said interior wall surface engaged by said wall member end edges constitutes one of said front and back tank side walls.

6. In a water closet as claimed in claim 3 wherein said tank side walls include front, back and end side walls and said interior vertical wall surfaces engaged by said wall member end edges and by said vacuum cups constitute internal surfaces of said front and back side walls.

7. In a water closet of the type having a tank formed by bottom and side walls and providing a hydraulic head and storage of predetermined height and capacity, having a movable flush valve mounted in the bottom wall of the tank and seated in one end of a conduit connecting the tank to a lower positioned bowl, having manual handle means adapted to open the valve to empty the tank and cooperative water supply means for refilling the tank upon the valve returning to a closed position, the opening of the valve normally causing initiation of flushing and bowl evacuation followed by substantial emptying of the tank and then closing of the valve, the improvement comprising, in combination:

a. an auxiliary thin wall member adapted to be vertically positioned and bent within the tank whereby selected edges of the wall member contact selected interior wall surfaces of the tank and said wall member forms in effect a tubular open top column extending above and around the valve and closed at the bottom by the tank bottom wall, said column having a predetermined volume and configuration selected such that said wall member adapts to being installed and to form said column in said tank without disturbing the normal functioning of the handle and water supply means or reducing the hydraulic head above the valve;

b. retainer means adapted to retain said wall member in said column and with the respective contacting wall member edges and tank wall surfaces in relatively tight engagement to minimize water flow therebetween, said wall member and retainer means thereby being effective upon said valve being opened to prevent emptying of said tank below a level substantially equal to the level of said column top end and to thereafter cause said valve to seat and said tank to start refilling; and c. sealing means in the nature of a thin flap formed integral with each respective contacting wall member edge adapting each such edge upon its respective thin flap being relatively tightly engaged against a selected said interior wall surface to form a hydraulic seal during said flushing.

8. Water saving apparatus for use with a toilet flush tank of the type having side and bottoms walls providing a relatively deep water chamber providing an adequate head for flushing a toilet and formed with a flush outlet and flush valve in its bottom wall and with a handle for operating the flush valve, said water saving apparatus comprising:

an elongated member formed of imperforate sheet material and having bottom and end edges formed with a substantially continuous seal, said bottom edge being sealingly engageable with the bottom wall of the flush tank and the end edges being sealingly engageable with one of the side walls of the flush tank in surrounding relationship to the flush outlet and flush valve so as to extend upwardly for only a portion of the height of the water chamber in the flush tank forming a substantially watertight compartment around the flush valve and closed at the bottom by the tank bottom wall with a portion of the water in the chamber of the tank being disposed above the said compartment and a portion of the water in the chamber being disposed below the top of the compartment so that when the flush valve is opened, substantially only the water above the compartment will flow outwardly through the flush outlet and the remainder of the water will remain within the flush tank.

9. Water saving apparatus as set forth in claim 8 including a pair of brackets formed on the outer surface of the sheet material adjacent opposite ends thereof and a pair of telescopic rods shiftable between contracted and extended position with spring means for normally urging them into extended position and formed with suction cups at one end thereof, said rods being engageable with the brackets on the sheet material member with the suction cups engageable with the side wall of the tank opposite the wall engaged by the end edges of the sheet material member for retaining said sheet material member in position assembled around the flush outlet and flush valve with the edges in sealing engagement with the bottom and side wall of the flush tank.

10. Water saving apparatus as claimed in claim 8 including retainer means adapted to engage a selected interior surface of said tank and maintain said bottom and end edges sealably engaged with said respective bottom and side walls.

11. In a water closet of the type having a tank formed by bottom and side walls and providing a hydraulic head and storage of predetermined height and capacity, having a movable flush valve mounted in the bottom wall of the tank and seated in one end of a conduit connecting the tank to a lower positioned bowl, having manual handle means to open the valve to empty the tank and cooperative water supply means for refilling the tank upon the valve returning to a closed position, the opening of the valve normally causing initiation of flushing and bowl evacuation followed by substantial emptying of the tank and then closing of the valve, the improvement comprising, in combination:

a. an auxiliary thin rectangular wall member adapted to be vertically positioned and bent within the tank into a U-like form whereby the end edges of the wall member contact an interior vertical wall surface of the tank and one of the side edges of the wall member contacts the interior bottom wall surface to form in effect an open top column extending above and around the valve and closed at the bottom by the bottom wall of the tank and closed at the sides by said interior vertical wall surface forming a continuation of the wall area of said wall member; and b. resilient retainer means adapted to retain said wall member in said column form and with the respective contacting wall member end and side edges and tank wall surfaces in relatively tight engagement to minimize water flow therebetween, said wall member and retainer means thereby being effective upon said valve being opened to prevent emptying of said tank below a level substantially equal to the level of said column top end to cause said valve to seat and said tank to start refilling substantially immediately after said evacuation.

* * * * *

UNITED STATES PATENT OFFICE

CERTIFICATE OF CORRECTION

Patent No. 3,946,447 Dated March 30, 1976

Inventor(s) Jacob R. Moon, Sr. and Jacob R. Moon, Jr.

It is certified that error appears in the above-identified patent and that said Letters Patent are hereby corrected as shown below:

In Col. 3, line 45, "deep" should be --depth--.

In Col. 4, line 10, "will" should be --with--.

In Col. 4, line 62, the "." after 5 1/4" " should be a --,--.

In Col. 4, line 68, "through" should be --though--.

In Col. 7, line 21, "bottoms" should be --bottom--.

Jacob R. Moon, Jr. should be shown as co-inventor-

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*